US008235279B2

(12) United States Patent
Thingelstad

(10) Patent No.: US 8,235,279 B2
(45) Date of Patent: Aug. 7, 2012

(54) TOP OR BOTTOM STRUCTURE FOR A FOLDED CONTAINER

(75) Inventor: Lars Aksel Thingelstad, Drammen (NO)

(73) Assignee: Elopak Systems AG, Glattbrugg (CH)

( * ) Notice: Subject to any disclaimer, the term of this patent is extended or adjusted under 35 U.S.C. 154(b) by 110 days.

(21) Appl. No.: 12/452,448

(22) PCT Filed: Jul. 1, 2008

(86) PCT No.: PCT/GB2008/002272

§ 371 (c)(1),
(2), (4) Date: Jun. 28, 2010

(87) PCT Pub. No.: WO2009/004334

PCT Pub. Date: Jan. 8, 2009

(65) Prior Publication Data

US 2010/0270366 A1 Oct. 28, 2010

(30) Foreign Application Priority Data

Jul. 3, 2007 (GB) ..... 0712824.2

(51) Int. Cl.
*B65D 5/08* (2006.01)

(52) U.S. Cl. ..... 229/137; 229/184

(58) Field of Classification Search ..... 229/138, 229/125.42, 184

See application file for complete search history.

(56) References Cited

U.S. PATENT DOCUMENTS

| | | | | |
|---|---|---|---|---|
| 681,323 | A * | 8/1901 | Houghland | 229/184 |
| 2,132,925 | A * | 10/1938 | Bensel | 229/137 |
| 4,192,446 | A * | 3/1980 | Naito | 229/137 |
| 4,667,873 | A * | 5/1987 | Yasui et al. | 229/137 |
| 4,702,410 | A * | 10/1987 | Derving | 229/184 |
| 5,056,707 | A * | 10/1991 | Larsen | 229/184 |
| 6,019,279 | A * | 2/2000 | Tywoniuk | 229/137 |
| 6,328,204 | B1 * | 12/2001 | Stacy-Ryan | 229/137 |
| 2006/0124715 | A1 * | 6/2006 | Kortsmit et al. | 229/184 |

* cited by examiner

*Primary Examiner* — Gary Elkins
(74) *Attorney, Agent, or Firm* — Warn Partners, P.C.

(57) ABSTRACT

A plastics-coated paperboard carton blank comprises an end part for forming a bottom end closure of the carton; the end part comprises first, second, third and fourth end panels (6-9) whereof the first and third end panels (6,8) are for forming outside panels (6,8) of the end closure and the second and fourth panels (7,9) are for forming inside panels (7,9) of the end closure; the free end portion (12) of the third end panel (8) is cut out at both sides in a laterally symmetrical manner with respect to its middle, so as to leave a central tongue (17), and the free end portions (11,13) of the second and fourth panels (7,9), respectively, are cut out at their sides adjacent to the third end panel (8), so as to form respective cut-outs (36,40); and the cut-outs (36,40) have respective edges (32,34) thereof which are further from the tongue (17) disposed obliquely relative to adjacent edges (42,44) of the respective cut-outs (36,40) and diverging outwardly relative to each other.

13 Claims, 5 Drawing Sheets

TOP OR BOTTOM STRUCTURE FOR A FOLDED CONTAINER

This application is a National Stage of International Application No. PCT/GB2008/002272, filed Jul. 1, 2008. This application claims priority to Great Britain Patent Application No. 0712824.2 filed on Jul 3, 2007. The disclosures of the above applications are incorporated herein by reference.

This invention relates to a top or bottom structure for a container, in particular, but not exclusively, a square-section tubular carton formed of paperboard with innermost and outermost thermally adhesive, moisture barrier, plastics layers.

Three examples of known top or bottom structures for a plastics-coated paperboard carton are shown in FIGS. 1 to 4 of the drawings of GB-A-2,176,767, which are re-used as the accompanying FIGS. 1 to 4, in which:—

Figure 1:
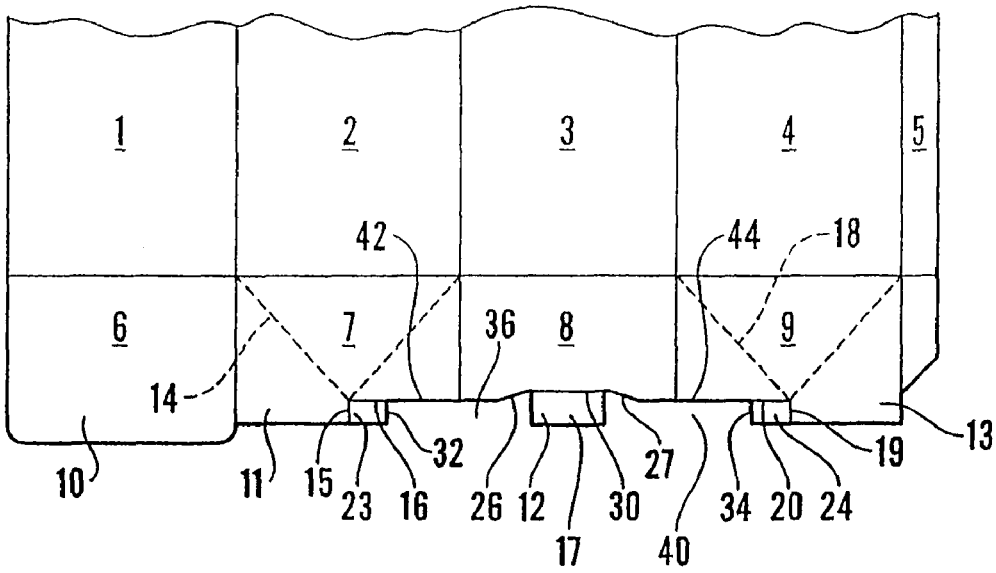
Fig. 1 Prior Art
FIG. 1 is a plan view of one known version of a bottom structure of a known carton blank before folding, as seen from the outer surface.

In FIG. 1, solid lines within the profile of the blank designate score lines of a crest-form cross-section, while broken lines designate score lines of a valley-form cross-section.

Side panels 1, 2, 3 and 4 and a bonding panel 5 integrated through score lines are connected with a top portion (not shown) for forming a top of the carton, and with a bottom portion for forming the bottom. The bottom portion is formed of a set of opposed outside bottom panels 6 and 8 and a set of opposed inside bottom panels 7 and 9. Isosceles triangular score lines 14 and 18 having, as respective bases, score lines at the side panels 2 and 4 are formed in the panels 7 and 9 to enable folding thereof towards the inside of the carton.

Further, end portions 10, 11, 12 and 13 are incorporated in the bottom panels 6, 7, 8 and 9, respectively. The end portion 10 of the panel 6 is not folded, but protrudes downwardly beyond the other end portions 11, 12 and 13. The end portion 12 of the panel 8 is cut out at both sides in a laterally symmetrical manner with respect to its middle, so as to leave a central tongue 17, and the end portions 11 and 13 of the panels 7 and 9, respectively, are cut out at their sides adjacent to the panel 8. These end portions 11 and 13 have score lines 15 and 19 extending from the apices of the isosceles triangular score lines 14 and 18 formed in the panels 7 and 9, respectively, and score lines 16 and 20 from those apices towards the panel 8. The score lines 15 and 16 provide a flap 23, while the score lines 19 and 20 provide a flap 24. The widths of the cut-outs of the end portions 11 and 13 are two-fifths or less of the entire widths of the end portions 11 and 13.

In addition, cut-outs 26 and 27 formed inwardly of the panel 8 are located to the right and the left of the tongue 17, and a score line 30 is formed rectilinearly between the deepest parts of the cut-outs 26 and 27.

Figure 2:
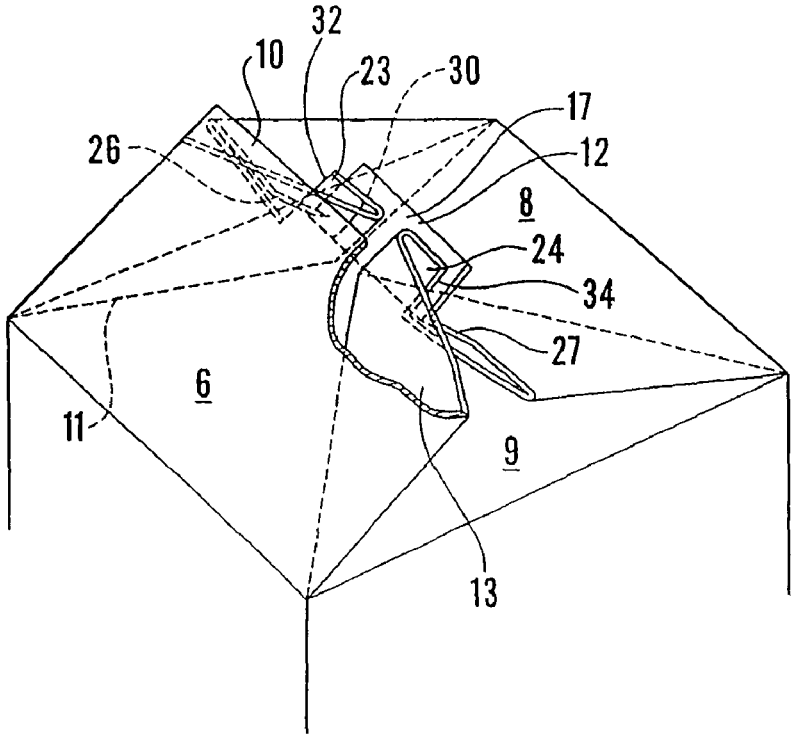
Fig. 2 Prior Art
FIG. 2 is a perspective view of the known carton in the course of its bottom-forming.

Prior to forming the bottom of the carton, the panel 5 is bonded to the inside of the panel 1 and the flat sleeve thus formed is opened out into a square-section tubular shape. After pre-breaking of the panels 6 to 9, the appropriate parts thereof are heated to render their plastics coatings tacky and then, as shown in FIG. 2, the panels 7 and 9 are pressed inwards and thus folded on the score lines 14 and 18, and the folded end portions 11 and 13 are received between the end portions 10 and 12, and bonded by pressure applied to the inner and outer surfaces of the bottom. Meanwhile, tongue 17 is folded at 180 degrees at the inside of the end portion 11, 23, 13 and 24. Since the score lines 15, 16, 19, 20 and 30 are to provide for folding through 180 degrees, and strong forces are applied thereto, it is desirable for them to be thicker score lines.

Figure 3:
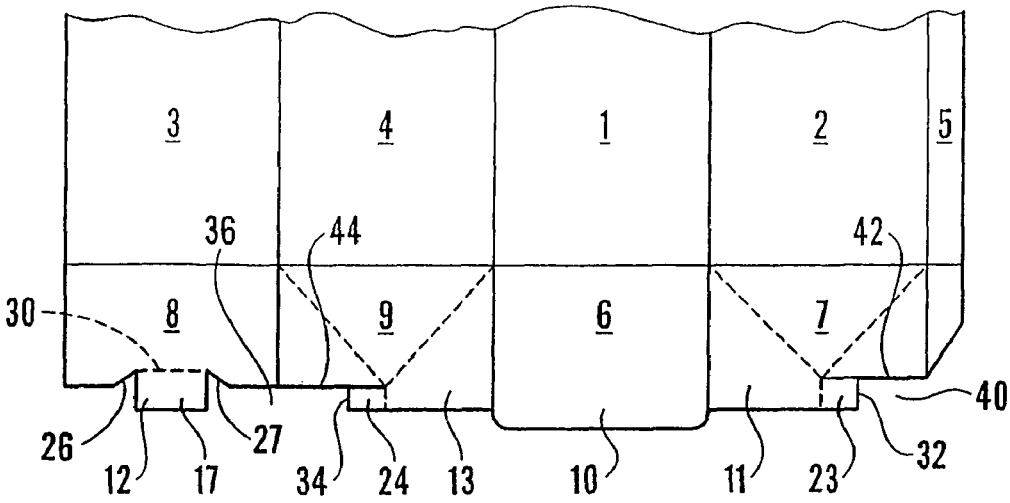
Fig.3 Prior Art
FIGS. 3 and 4 are plan views of respective other known versions of that bottom structure of the blank.

In the version shown in FIG. 3, the blank has a different bottom structure. Although the panels 1 to 5 are disposed differently in this version, basically the same bottom structure is provided on the carton as with FIGS. 1 and 2.

Figure 4:
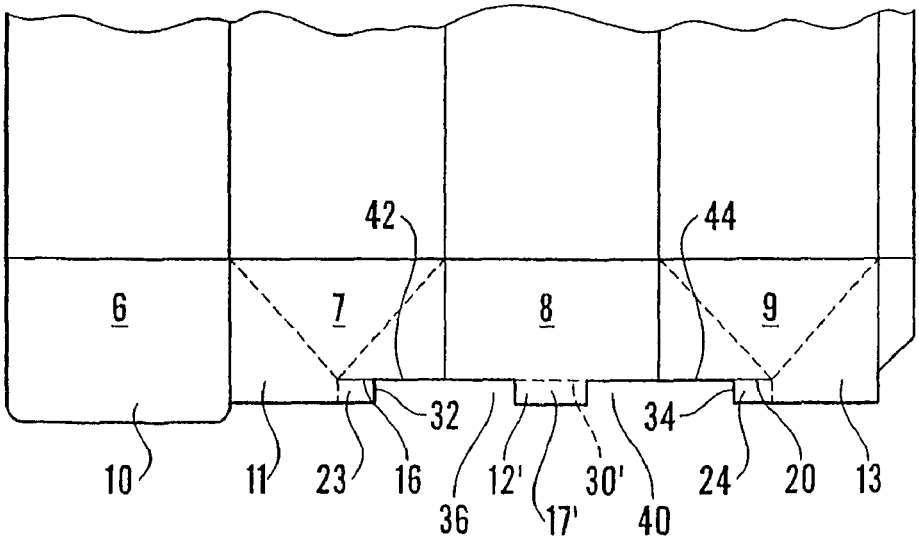
Fig.4 Prior Art

FIG. 4 shows a version upon which the versions shown in FIGS. 1 to 3 were deemed to be an improvement. In this version, the score line 30' between the tongue 17' and the remainder of the panel 8 is co-linear with the score lines 16 and 20 and, after fully folding inwards of the panels 6 to 9 during forming of the carton bottom, the fold line provided by the score line 30' is located immediately directly inwards of the fold lines provided by the score lines 16 and 20.

The above-mentioned GB-A-2,176,767 discloses that, when the folding line 30' of tongue 17' is disposed on the same line as the folding lines 16 and 20, there are applied to the tongue 17' not only the perpendicular pressing force for flattening the bottom but also the transverse force for pressing towards the outside bottom panel 8, so that cracks are formed at the right and left ends of the root of the tongue 17', thereby sometimes allowing the liquid contained in the carton to leak out. It explains that the cut-outs 26 and 27 are provided to enable the tongue 17 to fold at a position slightly inwards of the outermost edge of the remainder of the panel 8, so that the fold line provided by the score line 30 is offset from the fold lines provided by the score lines 16 and 20 in the formed bottom closure.

However, in all of those three known versions, those edges 32 and 34 of the main cut-outs 36 and 30 which come to lie adjacent the tongue 17 or 17' in the final end closure are perpendicular to the respective immediately adjacent edges 42 and 44 of the respective cut-outs 36 and 30. The inventor(s) believe(s) that these square cuts induce additional vertical folds in the triangular sub-panels adjacent to the flaps 23 and 24; in particular, the flaps are not folded along the score lines 16 and 20, as intended.

According to one aspect of the present invention, there is provided a plastics-coated paperboard carton blank comprising a first series of panels comprised of first, second, third and fourth body panels and a bonding panel integrated through score lines and connected with an end part for forming an end closure of the carton; the end part comprises a second series of panels comprised of first, second, third and fourth end panels which are integrated through further score lines with the respective body panels and whereof the first and third end panels are for forming outside panels of the end closure and the second and fourth panels are for forming inside panels of the end closure; substantially isosceles triangular score lines having, as respective babes, score lines at the second and fourth body panels are formed in the second and fourth end panels to enable folding thereof towards the inside of the carton; the end panels have respective free end portions; the free end portions of the second, third, and fourth end panels have lines of weakness extending longitudinally of the series comprised of the end panels; the free end portion of the first end panel protrudes outwardly beyond the other end portions; the free end portion of the third end panel is cut out at both sides in a laterally symmetrical manner with respect to its middle, so as to leave a central tongue, and the free end portions of the second and fourth panels, respectively, are cut out at their sides adjacent to the third end panel, so as to form respective cut-outs; characterized in that said cut-outs have respective oblique edges thereof which are further from said tongue disposed obliquely relative to adjacent edges of the respective cut-outs and diverging outwardly relative to each other.

According to another aspect of the present invention, there is provided a top or bottom end closure of a plastics-coated paperboard carton, comprising opposed, inner and outer, outside panels; opposed inside panels having score lines of isosceles triangular shape; end portions of the respective panels, with the end portion of the outer outside panel projecting further than the other end portions and the end portion of the inner outside panel terminating in a middle tongue; and cut-outs formed in the end portions of the inside panels at respective sides of those end portions adjacent to the inner outside panel, characterized in that said cut-outs have those respective edges thereof which come to lie adjacent said tongue in the final end closure disposed obliquely relative to the adjacent edges of the respective cut-outs and diverging outwardly relative to each other.

Owing to the invention, it is possible to avoid the formation of the unwanted vertical folds.

The angles of the oblique edges to the respective adjacent edges are obtuse, i.e. between 90 degrees and 180 degrees, exclusive, advantageously between one-and-one-third and one-and-two-thirds of a right-angle, preferably one-and-one-half of a right-angle. Moreover, the oblique edges need not be straight but may be curved.

In order that the invention may be clearly and completely disclosed, reference will now be made, by way of an example of the present invention, to FIG. 5 of the accompanying drawings, which is an internal plan view of a blank for forming into a carton.

Figure 5:
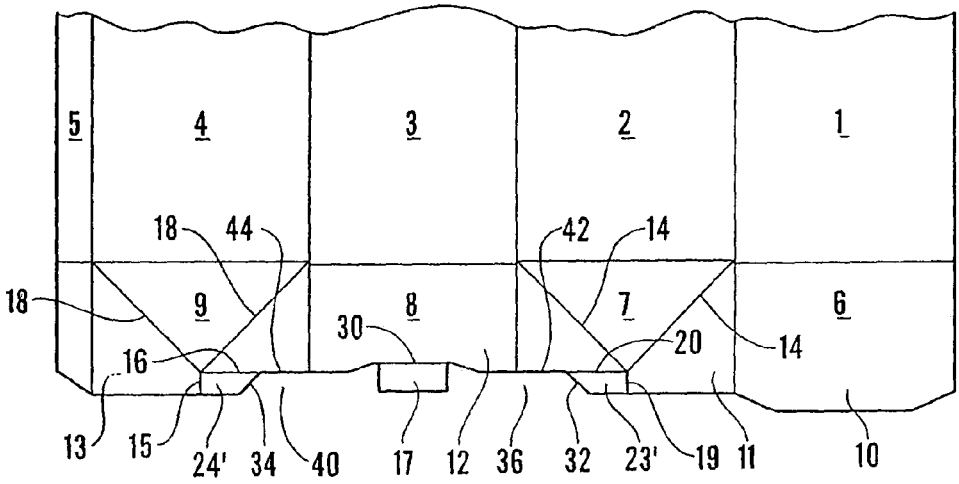
FIG. 5 is a plan view of a bottom structure of a carton blank, in accordance with the present invention.
Figure 6:
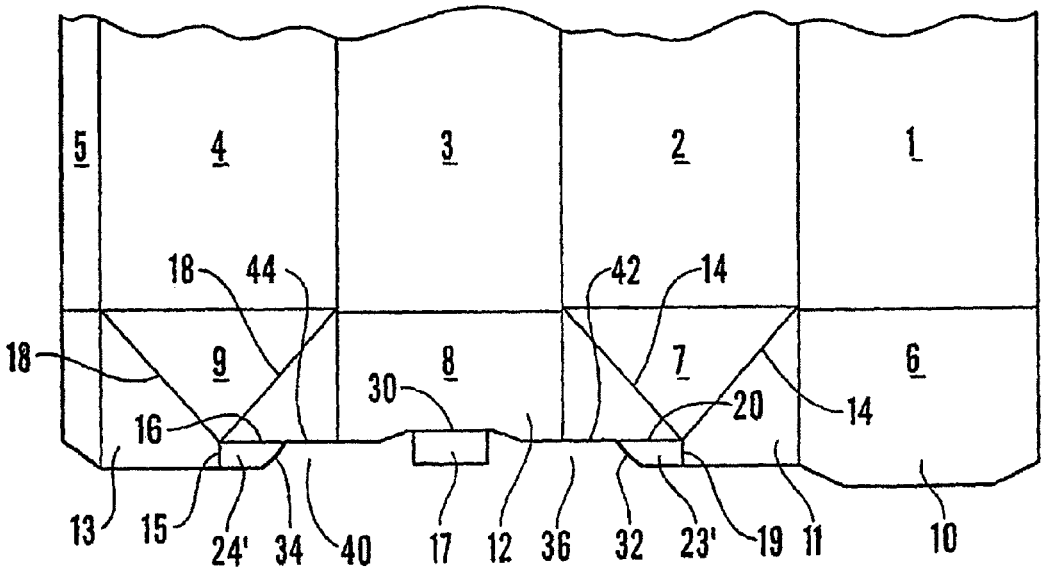
FIG. 6 is a plan view of a bottom structure of a carton blank, in accordance with the present invention.
Figure 7:
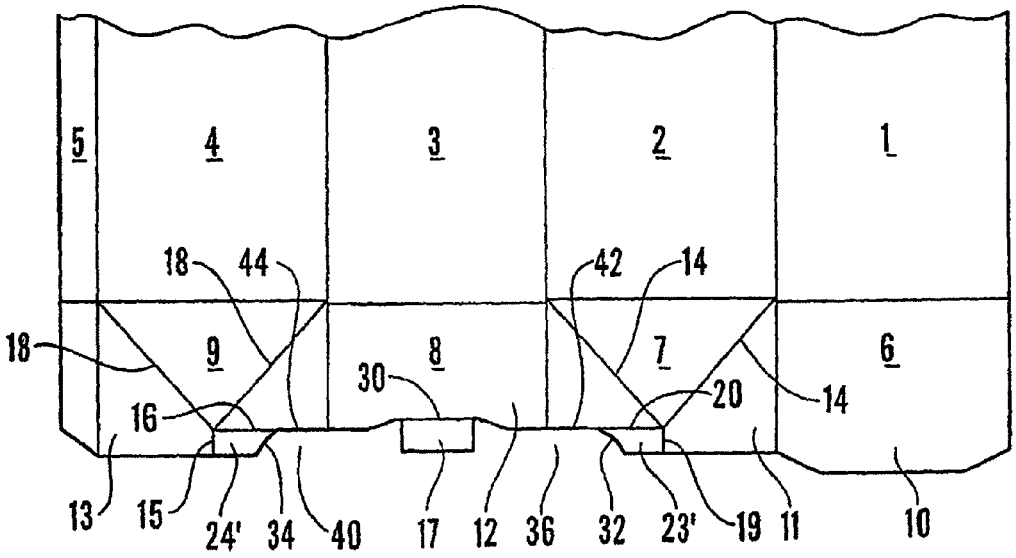
FIG. 7 is a plan view of a bottom structure of a carton blank, in accordance with the present invention.

Referring to FIG. 5, it will be understood that the blank shown therein is virtually identical to that shown in FIG. 1, with the exception that those edges 32' and 34' of the respective main cut-outs 36 and 40 which are at the opposite edges of those cut-outs from the tongue 17, i.e. those edges which come to lie adjacent to the tongue 17 in the final end closure, are oblique to the adjacent edges 42 and 44 of the cut-outs 36 and 40, in this example at an angle of one-half of a right-angle thereto, and diverge outwardly (i.e. away from the middle of the blank) towards each other. By providing those obtuse angles between the edges 32' and 34' and the edges 42 and 44, respectively, the sharp, right-angle corners are avoided, so seemingly promoting folding of the flaps 32 and 34 along their horizontal scorelines 16 and 20, as desired, to avoid the formation of the aforementioned unwanted vertical folds.

I claim:

1. A plastics-coated paperboard carton blank comprising a first series of panels comprised of first, second, third and fourth body panels and a bonding panel integrated through score lines and connected with an end part for forming an end closure of the carton; the end part comprising a second series of panels comprised of first, second, third and fourth end panels which are integrated through further score lines with the respective body panels and whereof the first and third end panels are for forming outside panels of the end closure and the second and fourth panels are for forming inside panels of the end closure; substantially isosceles triangular score lines having, as respective bases, score lines at the second and fourth body panels are formed in the second and fourth end panels to enable folding thereof towards the inside of the carton; the end panels have respective free end portions; the free end portions of the second, third, and fourth end panels lines of weakness extending longitudinally of the series comprised of the end panels; the free end portion of the first end panel protruding outwardly beyond the other end portions; the free end portion of the third end panel being cut out at both sides in a laterally symmetrical manner with respect to its middle, so as to leave a central tongue, and the free end portions of the second and fourth panels, respectively, are cut out at their sides adjacent to the third end panel, so as to form respective cut-outs; said cut-outs having respective first edges thereof and respective second edges thereof, the second edges being adjacent to, and further from said tongue than, the respective first edges, wherein the second edges are disposed obliquely relative to the respective first edges and diverging outwardly relative to each other.

2. A blank according to claim 1, wherein the respective angles of the second edges to the respective first edges are each between one-and-one-third and one-and-two-thirds of a right-angle.

3. A blank according to claim 2, wherein the second edges are curved.

4. A blank according to claim 2, wherein each of said angles is one-and-one-half of a right-angle.

5. A blank according to claim 4, wherein the second edges are curved.

6. A blank according to claim 1, wherein the second edges are curved.

7. A blank according to claim 1, wherein said end part is a bottom end part for forming a bottom end closure of said carton.

8. A top or bottom end closure of a plastics-coated paperboard carton, comprising opposed, inner and outer, outside panels; opposed inside panels having score lines of isosceles triangular shape; end portions of the respective panels, with the end portion of the outer outside panel projecting further than the other end portions and the end portion of the inner outside panel terminating in a middle tongue; and cut-outs formed in the end portions of the inside panels at respective sides of those end portions adjacent to the inner outside panel, wherein the improvement comprises that said cut-outs have those respective edges thereof which come to lie adjacent said tongue in the final end closure disposed obliquely relative to the adjacent edges of the respective cut-outs and diverging outwardly relative to each other.

9. An end closure of a carton according to claim 8, wherein the angles of the oblique edges to the respective adjacent edges are each between one-and-one-third and one-and-two-thirds of a right-angle.

10. An end closure of a carton according to any one of claim 9, wherein the oblique edges are curved.

11. An end closure of a carton according to claim 9, wherein each of said angles is one-and-one-half of a right angle.

12. An end closure of a carton according to claim 11, wherein the oblique edges are curved.

13. An end closure of a carton according to claim 8, wherein the oblique edges are curved.

* * * * *

UNITED STATES PATENT AND TRADEMARK OFFICE

CERTIFICATE OF CORRECTION

PATENT NO. : 8,235,279 B2
APPLICATION NO. : 12/452448
DATED : August 7, 2012
INVENTOR(S) : Lars Aksel Thingelstad It is certified that error appears in the above-identified patent and that said Letters Patent is hereby corrected as shown below:

Column 2,
Line 57 “babes” should be -- bases --.

Signed and Sealed this
Ninth Day of April, 2013

Teresa Stanek Rea
*Acting Director of the United States Patent and Trademark Office*